US006566645B1

(12) United States Patent
Murphey

(10) Patent No.: US 6,566,645 B1
(45) Date of Patent: May 20, 2003

(54) REMOTE SYSTEM TRIGGER CIRCUIT

(76) Inventor: James D. Murphey, 2438 W. Butler, Phoenix, AZ (US) 85021

( * ) Notice: Subject to any disclaimer, the term of this patent is extended or adjusted under 35 U.S.C. 154(b) by 0 days.

(21) Appl. No.: 09/741,577

(22) Filed: Dec. 19, 2000

(51) Int. Cl.[7] ..... H01I 37/244; G08B 13/18
(52) U.S. Cl. ..... 250/221; 250/222.1; 340/555
(58) Field of Search ..... 250/221, 222.1, 250/214 A, 214 B, 214 R, 214.1, 214 SW; 340/551, 555, 556, 572.1, 572.2, 573.1, 545.1, 545.3

(56) References Cited

U.S. PATENT DOCUMENTS 4,879,461 A 11/1989 Philipp
5,126,555 A 6/1992 Hawryluk
5,268,568 A 12/1993 Lee
5,382,163 A 1/1995 Putnam
5,416,316 A 5/1995 Kappeler
5,502,297 A * 3/1996 Sherman ..... 235/472
5,780,842 A 7/1998 Murphey
5,790,303 A 8/1998 Weston et al.
5,814,799 A 9/1998 Swartz et al.
6,025,200 A * 2/2000 Kaish et al. ..... 436/56
6,028,516 A 2/2000 Murphey

* cited by examiner

*Primary Examiner*—Robert H. Kim
*Assistant Examiner*—Hoon K. Song
(74) *Attorney, Agent, or Firm*—Parsons & Goltry; Robert A. Parsons; Michael W. Goltry

(57) ABSTRACT

A trigger circuit including a light source supplying a first beam of light having a first frequency, a frequency altering device positionable to receive the first beam of light. The frequency altering device receiving the first beam of light and transmitting a second beam of light having a second frequency. A frequency sensitive component operable in response to the second beam of light having the second frequency, the frequency sensitive component being positioned to receive the second beam of light and provide a trigger signal. A transmitter transmits an initiation signal upon receipt of the trigger signal, and a remote receiver receives the initiation signal and triggers the remote system.

6 Claims, 1 Drawing Sheet

REMOTE SYSTEM TRIGGER CIRCUIT

FIELD OF THE INVENTION

This invention relates to triggering circuits for triggering the operation of remote systems.

More particularly, the present invention relates to a triggering circuit dependent on light.

BACKGROUND OF THE INVENTION

There are many systems today, such as automobiles, computers, financial systems, etc. which, for security reasons, require limited or authorized access. Many of these systems operate with keys, cards, etc., which can often either be duplicated or bypassed. It would be advantageous to not only gain access to the system using these devices, but also to provide additional security in the form of a trigger which will actuate the operation of a system upon specific conditions.

Often, access to systems is regulated by very costly and complicated security systems which require coding and comparisons using expensive processing units. For example, security doors include a magnetic strip reader which collects a code from a magnetic strip. The code is compared by a processing unit to stored codes, and then, depending upon the comparison, the processing unit initiates certain activities such as operating the door opening system. Due to the high cost of these security systems, security is often ignored on simple low cost systems.

Additionally, most security systems require an individual's actual presence for operation. For example, a key card is used at a door to open that door. However, it is often necessary to operate remote devices in a secured manner. Currently, this is not taught by the art.

It would be highly advantageous, therefore, to remedy the foregoing and other deficiencies inherent in the prior art.

Accordingly, it is an object of the present invention to provide a new and improved trigger circuit for triggering a remote system.

Another object of the present invention is to provide a trigger circuit to enhance security and/or identification in a remote system.

And another object of the present invention is to provide a trigger circuit which is relatively less costly and can be economically employed on even the simplest remote systems.

SUMMARY OF THE INVENTION

Briefly, to achieve the desired objects of the instant invention in accordance with a preferred embodiment thereof, provided is a trigger circuit including a light source supplying a first beam of light having a first frequency, a frequency altering device positionable to receive the first beam of light. The frequency altering device receiving the first beam of light and transmitting a second beam of light having a second frequency. A frequency sensitive component operable in response to the second beam of light having the second frequency, the frequency sensitive component being positioned to receive the second beam of light and provide a trigger signal. A trigger coupled to receive the trigger signal and, upon receipt of the trigger signal, triggering the system.

In a specific embodiment the frequency sensitive component includes a photo-transistor, a potentiometer and a JFET coupled to the photo-transistor to adjust the component to be sensitive to the second frequency. The frequency sensitive component can further include a light filtering device which transmits only the second beam of light with the second frequency. The light filtering device is positioned to receive the beam of light from the frequency altering device and the photo-transistor is positioned to receive the second beam of light from the light filtering device and provide a trigger signal in response thereto.

BRIEF DESCRIPTION OF THE DRAWING

The foregoing and further and more specific objects and advantages of the instant invention will become readily apparent to those skilled in the art from the following detailed description of preferred embodiments thereof taken in conjunction with the drawing in which.

DESCRIPTION OF THE PREFERRED EMBODIMENT

Figure 1:
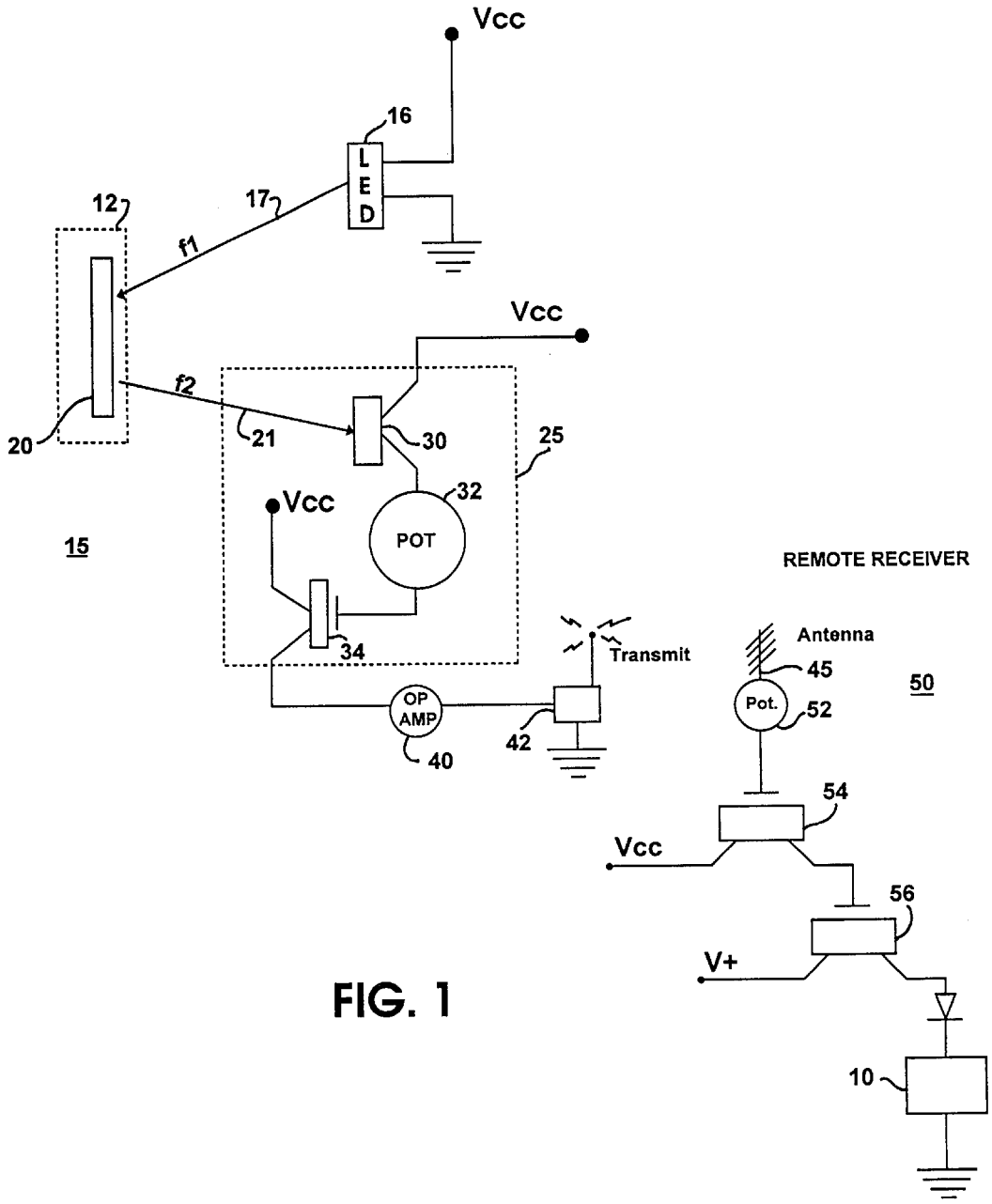
FIG. 1 is a schematic diagram of a remote trigger circuit.

Turning to the drawing, a trigger circuit 15 for remotely triggering the operation of a system 10 is illustrated. System 10 can be any system in which security and/or identification is desired. Examples of which are secure entry or operating systems (e.g. security badges for opening doors or operating systems), automotive entry or operation, financial identification such as credit or debit cards etc. Much simpler systems, ordinarily not secured, can also benefit from the present invention.

Trigger circuit 15 includes a light source 16 coupled to a power source Vcc which may be an independent power source if desired. Light source 16 supplies a light beam 17 including a first frequency $f_1$. Light source 16 is preferably a light emitting diode (LED), laser, or the like, and can be narrow band such as a specific color or wide band such as white light. Light source 16 is positioned in relation to a receptacle 12 such that light beam 17 is directed therein. For purposes of illustration, receptacle 12 is provided for receiving a detachably portable unit such as a key, a card, or the like as will be described presently.

A frequency altering device 20 is positionable within receptacle 12 to receive light beam 17 from light source 16. Frequency altering device 20 receives light beam 17 and, in response to reception of light beam 17, transmits a light beam 21 having a second frequency. In a preferred embodiment, frequency altering device 20 is incorporated into a key, a card, or any other convenient structure which provides a substrate for support and for convenient use. It will be understood that the terms key and card designate structures for supporting and/or containing the frequency altering device. In the preferred embodiment, frequency altering device 20 includes fluorescent material, such as phosphor or actinical materials, preferably incorporated in a card, a key or the like. Actinical is a dielectric, which includes and encompasses all light reagents, such as silicon, phosphor, fluorescence, radium, platinocyanide; whether chemical, bio, metal, gases, or oxidants; anything acting, responding, or changeable by light radiation. The fluorescent material is preferably applied directly to a substrate. Upon receiving light beam 17, the material of frequency altering device 20 is activated to emit light beam 21 with an altered frequency ($f_2$). Light beam 21 is emitted from receptacle 12.

A frequency sensitive component 25, generally designated by broken line, includes a photo-transistor 30 having a first terminal connected to a power source, such as power source Vcc. A second terminal of photo-transistor 30 is coupled through a potentiometer 32 to the control terminal of a junction field effect transistor (JFET) 34. Here it should be understood that several different frequency sensitive or selective features can be incorporated individually or in combination. For example, photo-transistor 30 can be designed to be sensitive to a single frequency (narrow band) or to a wide band of frequencies. Also, JFET 34 can be designed to be sensitive to a single frequency (narrow band) or to a wide band of frequencies with potentiometer 32 operating in conjunction therewith to provide frequency sensitive or selective operation. It will be understood by those skilled in the art that additional components (not shown for simplicity) may be included to enhance the desired frequency selectivity.

The source terminal of JFET 34 is connected to a power source such as Vcc and the drain terminal provides a trigger signal. Frequency sensitive component 25 is adjusted to be sensitive to light beam 21 as long as it has a frequency $f_2$. As discussed previously, frequency $f_2$ can be either a single frequency (narrow band) or a wide band of frequencies and light beam 17 can be only frequency $f_1$ or a wide band of antecedent frequencies. It will be understood that light source 16 and photo-transistor 30 along with any other integrated components, while illustrated as being outside receptacle 12, can be carried within receptacle 12 or can even define an area for receipt of frequency altering device 20 without the use of a receptacle.

The trigger signal is supplied through an operational amplifier 40 to a transmission device 42. Transmission device 42 can be substantially any device including but not limited to RF transmitters, optical transmitters, audio transmitters or other transmitters capable of sending 17 signals from the electromagnetic spectrum. Transmission device 42 acts as a trigger and upon receipt of the trigger signal, activates the operation of remotely located system 10 as will be described presently. The operation of remotely located system 10 is suspended pending a trigger signal resulting from the use of the correct frequency altering device 20. Thus, light beam 17 must be altered to a unique frequency to which frequency sensitive component 25 is adjusted to trigger the operation of remotely located system 10. Frequency altering device 20 alters the light beam 17 to provide the necessary unique frequency.

Signals transmitted by transmission device 42 are received at antenna 45 of remote receiver generally designated 50. The received signals are supplied through a potentiometer 52 to the control terminal of a JFET 54. A source terminal of JFET 54 is coupled to a power source such as Vcc, which can be a remote power source or the same source as used in trigger circuit 15, and the source, terminal is coupled to the control terminal of an actuating switch 56. The source terminal of switch 56 is coupled to a power source V+. It should be understood that power source V+ can be power source Vcc, or any other power source depending upon the specific application and which is sufficient to drive system 10. Upon receipts of the trigger signal, remote receiver 50 activates the operation of system 10. The operation of system 10 is suspended pending a trigger signal resulting from the use of the correct frequency altering device 20. Thus, light beam 17 must be altered to a unique frequency to which frequency sensitive component 25 is adjusted to trigger the operation of system 10. Frequency altering device 20 alters the light beam 17 to provide the necessary unique frequency.

It should be understood that while we have predominantly discussed security, the disclosed embodiment can also be employed for identification purposes. It will be understood that a switch can also be provided between operational amplifier 40 and a directly coupled system. The directly coupled system is disclosed in U.S. Pat. No. 6,028,516, issued Feb. 22, 2000 and entitled "Trigger Circuit" herein incorporated by reference.

Various other changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A trigger circuit for triggering the operation of a remote system, the trigger circuit comprising:

a light source coupled to a power source, supplying a first beam of light having a first frequency;

a frequency altering device positionable to receive the first beam of light from the light source, the frequency altering device receiving the first beam of light and transmitting a second beam of light having a second frequency;

a frequency sensitive component operable in response to the second beam of light having the second frequency, the frequency sensitive component being positioned to receive the second beam of light and provide a trigger signal;

a transmitter for emitting an initiation signal upon receipt of the trigger signal; and a remote receiver coupled to a remote system to receive the initiation signal and, upon receipt of the initiation signal, triggering the remote system.

2. A trigger circuit as claimed in claim 1 wherein the frequency sensitive component includes a photo-transistor sensitive to light including the second frequency and positioned to receive the beam of light from the frequency altering device.

3. A trigger circuit as claimed in claim 2 wherein the frequency sensitive component further includes a potentiometer and a JFET coupled to the photo-transistor to adjust the component to be sensitive to the second frequency.

4. A trigger circuit for triggering the operation of a remote system, the trigger circuit comprising:

a light source coupled to a power source, supplying a first beam of light having a first frequency;

a frequency altering device positionable to receive the first beam of light from the light source, the frequency altering device receiving the first beam of light and, in response to reception of the first beam of light, transmitting a second beam of light having a second frequency;

a frequency sensitive component including a photo-transistor, a potentiometer and a JFET coupled to the photo-transistor to adjust the component to be sensitive to the second frequency, the photo-transistor being positioned to receive the second beam of light and provide a trigger signal in response thereto;

a transmitter for emitting an initiation signal upon receipt of the trigger signal; and a remote receiver coupled to a remote system to receive the initiation signal and, upon receipt of the initiation signal, triggering the remote system.

5. A trigger circuit as claimed in claim 4 wherein the frequency altering device is included in a detachably portable unit.

6. A trigger circuit as claimed in claim 5 wherein the detachably portable unit includes one of a card and a key.

* * * * *